US006560828B1

(12) United States Patent
Gloystein

(10) Patent No.: US 6,560,828 B1
(45) Date of Patent: May 13, 2003

(54) STOWAGE PIECES FOR SECURING THE POSITION OF CONTAINERS PLACED ON BOARD SHIPS

(75) Inventor: Jürgen Gloystein, Bremen (DE)

(73) Assignee: Mac-Gregor Conver GmbH, Bremen (DE)

( * ) Notice: Subject to any disclaimer, the term of this patent is extended or adjusted under 35 U.S.C. 154(b) by 0 days.

(21) Appl. No.: 09/763,579

(22) PCT Filed: Jul. 7, 2000

(86) PCT No.: PCT/EP00/06434

§ 371 (c)(1),
(2), (4) Date: Feb. 21, 2001

(87) PCT Pub. No.: WO01/04024

PCT Pub. Date: Jan. 18, 2001

(30) Foreign Application Priority Data

Jul. 12, 1999 (DE) ..... 199 33 424

(51) Int. Cl.[7] ..... B65D 90/00; B60P 7/13
(52) U.S. Cl. ..... 24/287; 410/82
(58) Field of Search ..... 24/287, 332, 589, 24/590; 410/83, 85; 403/348, 350, 325, 385; 270/1.5; 206/159; 411/347, 552, 508

(56) References Cited

U.S. PATENT DOCUMENTS

| | | | | |
|---|---|---|---|---|
| 2,975,933 A | | 3/1961 | Abolins | |
| 3,894,493 A | * | 7/1975 | Strecker | 24/287 |
| 3,973,684 A | | 8/1976 | DiMartino | |
| 4,212,251 A | * | 7/1980 | DiMartino | 24/287 |
| 4,591,307 A | * | 5/1986 | Clive-Smith | 410/83 |
| 4,626,155 A | * | 12/1986 | Hlinsky et al. | 410/82 |
| 5,560,088 A | * | 10/1996 | Nitsche et al. | 24/287 |

FOREIGN PATENT DOCUMENTS

| | | | |
|---|---|---|---|
| DE | 7136868 | 1/1972 | |
| DE | 2443554 | 3/1976 | |
| DE | 8230241 | 4/1983 | |
| DE | 3321807 | 12/1984 | B63B/25/28 |
| DE | 3330067 | 4/1988 | B63B/25/22 |
| DE | 275218 | 1/1990 | B63B/25/22 |
| FR | 2276234 | 1/1976 | B65D/19/00 |
| JP | 11105617 | 4/1999 | B60P/7/13 |

* cited by examiner

*Primary Examiner*—Robert J. Sandy
(74) *Attorney, Agent, or Firm*—Technoprop Colton LLC

(57) ABSTRACT

Stowage pieces (10) are used to secure containers on board ships against horizontal displacement. The stowage pieces (10) have an abutment (15), which on opposite sides has stowage cones (16, 17) which engage in upper and lower corner fittings (12, 13) of containers stacked one above another. These stowage pieces (10) must be fitted to upper corner fittings (13) of the containers already stowed on board the ship before a next container is stowed. This requires the use of auxiliary personnel on the containers already stowed on board the ship, which more recent safety regulations no longer permit.

The stowage piece (10) according to the invention has on its upper stowage cone (16) a rotatable cross-latch (21), by means of which the stowage piece (10) can be locked under lower corner fittings (12) of a container from the pier, before the container comes on board the ship. As a result, auxiliary personnel on the containers located on board the ship become superfluous.

22 Claims, 6 Drawing Sheets

STOWAGE PIECES FOR SECURING THE POSITION OF CONTAINERS PLACED ON BOARD SHIPS

BACKGROUND OF THE INVENTION

1. Technical Field

The invention relates to a stowage piece for securing the position of containers on board ships to a stowage piece for securing the position of containers on board ships, having an abutment, in particular a plate-like abutment, to be arranged at least partly between corner fittings of containers located one above another, and at least two stowage cones arranged on opposite sides of the abutment; and to a stowage piece for securing the position of containers on board ships, having an abutment and having at least two stowage cones arranged on opposite sides of the abutment.

2. Prior Art

Stowage pieces of the type discussed here are used for securing containers against displacement on board ships. In particular, the position of containers stowed below decks is secured with such stowage pieces, in order that the said containers cannot be displaced in the horizontal direction by more than a permissible amount. The stowage pieces are arranged between corner fittings of containers stacked one above another, specifically without connecting the containers in the vertical direction. Displacement of the containers in the horizontal direction is prevented by the stowage pieces, on the one hand by the fact that their stowage cones engage in adjacent corner fittings of containers stacked one above another, so that the containers are secured against mutual displacement in the stack. Furthermore, the containers of adjacent stacks are supported against each other, specifically depending on the manner of stowage in the longitudinal direction of the ship or in the transverse direction of the ship.

Known stowage pieces of this type are arranged between the individual containers in such a way that they are inserted into the upper corner fittings of containers already located (stowed) on board, and the upper containers are then placed on these, the stowage pieces coming into engagement with the lower corner fittings of the upper containers. This type of stowage requires the use of auxiliary personnel in the hold. The auxiliary personnel are at risk in the hold for various reasons. Therefore, more recent international regulations relating to health and safety at work permit the use of auxiliary personnel in the hold only on a conditional basis.

BRIEF SUMMARY OF THE INVENTION

On the basis of the above, the invention is now based on the object of providing stowage pieces which permit the simple and quick stowage of containers correspondingly secured in position on board ships, whilst complying with the appropriate (international) safety regulations.

A stowage piece to achieve this object has the features of claim 1. By means of the locking means assigned to one stowage cone and the rotation of the same into a locking and unlocking position by means of rotation of the opposite stowage cone, it is possible to pre-lock the stowage piece under the respective lower corner fitting of a container on land. The stowage pieces no longer need to be put in place by auxiliary personnel in the hold on, for example, containers that have already been stowed, before the next container is loaded.

According to a development of the stowage piece, the locking means, preferably a cross-latch, can be secured in the locking position by a locking means. The locking means is preferably designed such that it secures the lower rotatable stowage cone transferring the locking means into the locking position against being rotated. This lower stowage cone is freely accessible under the lower corner fittings of upper containers when the stowage piece is being pre-locked. The locking means can be designed in a wide range of ways. They preferably ensure force-fitting locking of the locking means (cross-latch) in at least the locking position.

According to a preferred configuration of the stowage piece, the locking means is arranged in a recess in the rotatable (lower) stowage cone. In this recess, the locking means is not only easily accessible; it may also be accommodated here so as to be protected against damage.

According to a development of the stowage piece according to the invention, which may be capable of independent protection, provision is made for the plate-like abutment between the opposite stowage cones to be assigned a centre piece, which is preferably connected to the abutment permanently and/or in one piece. The centre part is designed in such a way that it engages in a slot in a corner fitting arranged under that side of the abutment which is provided with the centre part and belonging to a container. The height of the centre part is in this case dimensioned such that it extends only over part of the overall depth of the slot. The other part of the slot is then filled by an upper section of the rotatable stowage cone, preferably a cone head. For this purpose, the centre part is assigned to that side of the abutment on which the rotatable stowage cone is located. The fact that both the centre part that is permanently connected to the abutment, and an upper part of the rotatable stowage cone, are located in the slot in the relevant corner fitting of a container means that the forcible rotation of the rotatable stowage cone in the slot in the corner fitting is avoided. By means of the force-fitting rotational securing, produced in this way, of the rotatable (lower) stowage cone, and the locking means (cross-latch) operatively connected thereto, the locking means is secured against the inadvertent detachment of the stowage piece from the lower corner fitting under overloading.

A further stowage piece for achieving the object mentioned at the beginning has the features of claim 5. According to this, the abutment is assigned a spacer between upright side faces of the containers or corner fittings, respectively. This spacer projects laterally with respect to a relevant wall of the container, which makes it possible to provide support in the horizontal direction against adjacent containers. Such supports are used, in particular, for so-called block stowage.

According to a preferred configuration of the invention, the distance piece has a thickness which corresponds approximately to half the spacing or interspace between mutually facing sides, in particular of the corner fittings, of adjacent containers. In this way, two stowage pieces between adjacent container stacks supplement each other, in that they together approximately bridge the spacing or interspace between adjacent container stacks and, as a result, support the containers in the horizontal direction against. compressive loads.

A further stowage piece for achieving the object mentioned at the beginning has the features of claim 15. This has a distance piece with a thickness which corresponds approximately to half the spacing (interspace) between mutually oriented sides of adjacent containers, in particular their corner fittings. If such stowage pieces are assigned to mutually oriented corner fittings on the sides of containers or container stacks located beside each other, they together approximately fill the spacing between adjacent side faces of the corresponding corner fittings, as a result of which block stowage of the containers in the longitudinal direction or transversely thereto below the deck of a ship can be brought about without separate means, in particular known compression pieces, which can therefore be eliminated by the stowage pieces according to the invention.

BRIEF DESCRIPTION OF THE DRAWINGS

Preferred exemplary embodiments of stowage pieces according to the invention will be explained in more detail below using the drawing, in which.

DETAILED DESCRIPTION OF THE PREFERRED EMBODIMENTS

The figures show various stowage pieces for securing the position of containers on board ships, specifically in particular in the hold of ships. The stowage pieces are used only to secure the containers against horizontal displacements. The stowage pieces do not couple the containers together in the vertical direction, so that the containers can be placed on one another (stacked) in an unimpeded manner and can be lifted off one another (unstacked).

Figure 1:
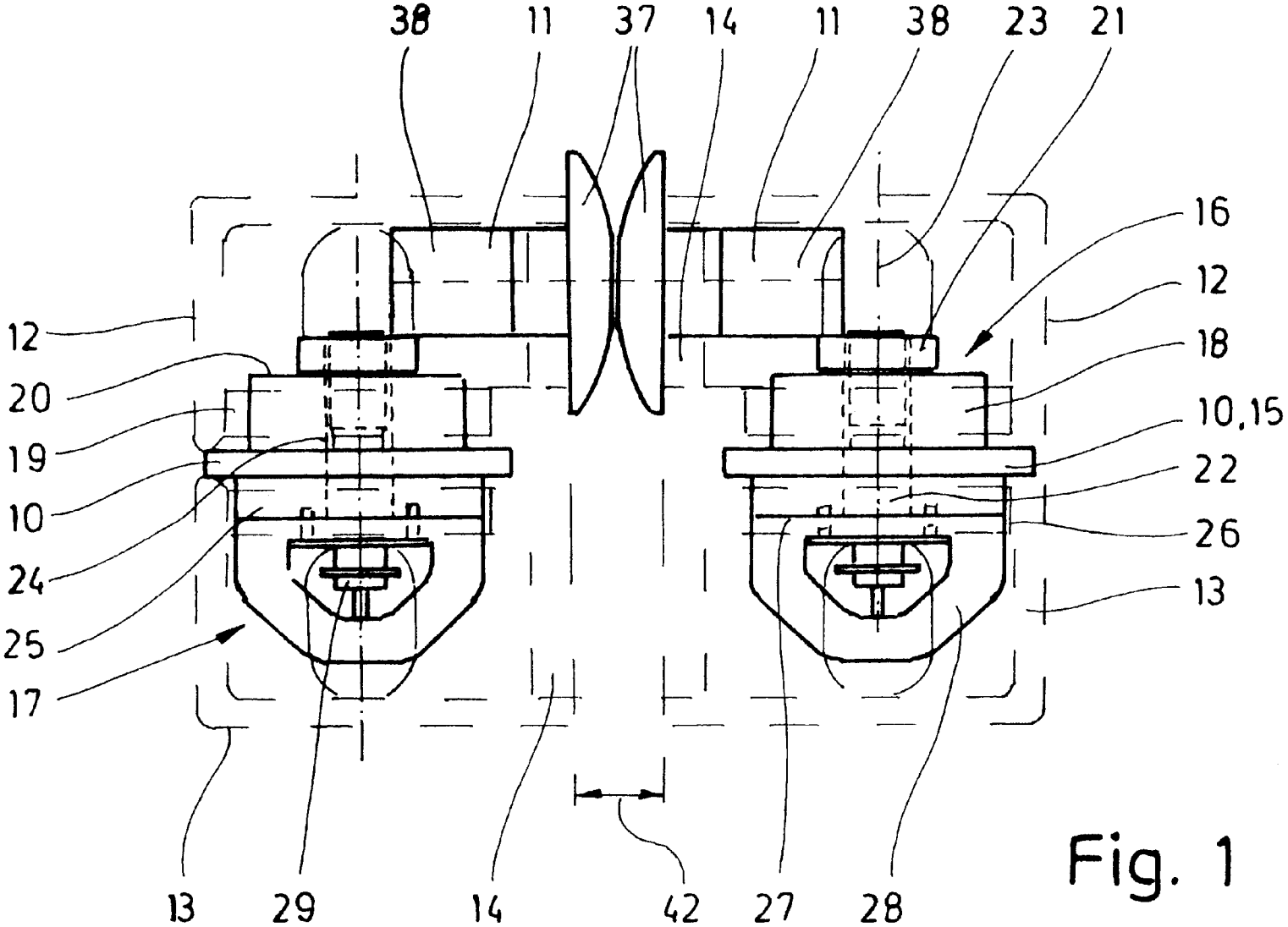
FIG. 1 shows upper and lower corner fittings of containers stacked one above another and beside one another and which are secured in position by different stowage pieces.
Figure 2:
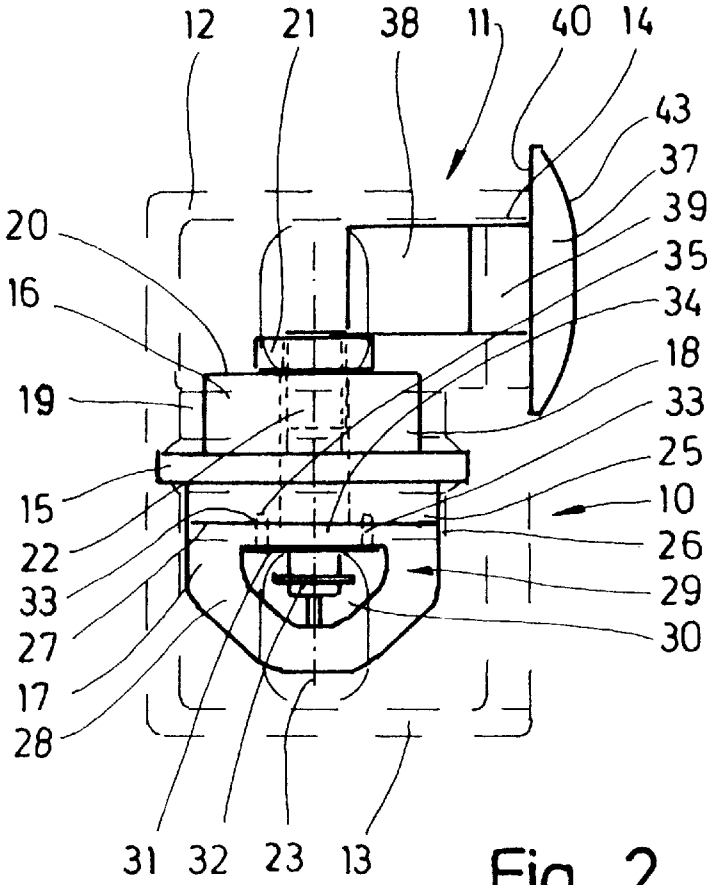
FIG. 2 shows the stowage pieces of FIG. 1, which have been pre-locked to a lower corner fitting of an upper container.
Figure 3:
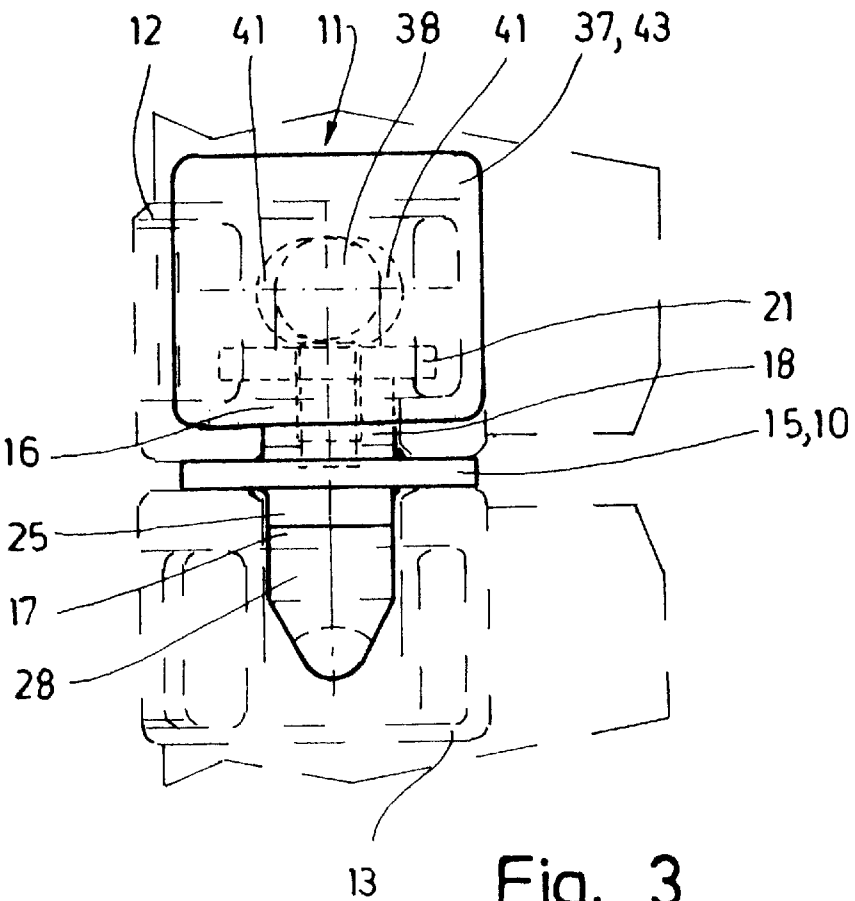
FIG. 3 shows the stowage pieces of FIG. 2 in a view rotated through 90°.

FIGS. 1 to 3 show how two different stowage pieces 10 and 11, which are given different tasks. The stowage piece 10 is arranged between a lower corner fitting 12 (illustrated dashed in the figures) of an upper container (not shown), and an upper corner fitting 13 of the lower container (likewise not shown) in the same container stack. The lower corner fitting 13 or the like can alternatively also be fixed to the floor of a hold, in particular an intermediate floor in the hold. In this case, the corner fitting 13 is not fixed to a container. The lower corner fitting 12 then belongs to a lowest container of a container stack. The stowage piece 10 is used to secure the containers stacked one above another in a container stack against horizontal displacement.

The stowage piece 11 is anchored in a lateral slot 14 in the corner fitting 12. This slot 14 is arranged in a side wall of the corner fitting 12, which is oriented in the same direction as an upright longitudinal side wall of the relevant container. However, it is also conceivable to insert the stowage piece 11 into a slot in an upright wall of the corner fitting 12 which runs approximately parallel to an end wall of the relevant container. The stowage piece 11 is used to support the containers of one container stack on containers of an adjacent container stack. The stowage pieces therefore transmit compressive forces between adjacent containers and form a block stowage system of the containers in the transverse or else longitudinal direction of the ship.

The stowage piece 10 has a central, plate-like abutment 15. The abutment 15 is arranged as a spacer between the upper and lower corner fittings 12 and 13 of containers stacked one above another or between a lower container in a container stack and the bottom of the hold. As related to the arrangement of the stowage piece 10 shown in FIGS. 1 to 3, one stowage cone 16 is arranged above the abutment 15 and one stowage cone 17 of a different design is arranged underneath the abutment 15. The upper stowage cone 16 has a centre piece 18 with an oval outline, which approximately fills the slot 19 on the underside of the lower corner fitting 12 of the upper container. The centre piece 18 is connected in one piece to the plate-like abutment 15. The height of the centre piece 18 is chosen such that the latter extends completely through the slot 19. In the exemplary embodiment shown, the centre piece 18 projects inwards into the corner fitting 12 somewhat with respect to the slot 19. The upper side 20 of the centre piece 18, which may project, is designed to be flat.

The upper stowage cone 16 has a connecting means which is designed here as a cross-latch 21. The flat, plate-like cross-latch 21 has an outline which corresponds to that of the centre piece 18, but is preferably somewhat smaller. In the locking position shown in the figures, the cross-latch 21, as referred to its longitudinal axis, runs transversely with respect to the longitudinal axis of the centre piece 18, as a result of which opposite end regions of the cross-latch 21 engage from the inside behind flat sections of the corner fitting 12 which are located laterally beside the slot 19 (FIG. 3). As a result, the stowage piece 10 is locked to the lower corner fitting 12 of the upper container. In an unlocked position, the cross-latch 21 is rotated through 90° with respect to the centre piece 18, so that the longitudinal axes of the two lie one above another, as a result of which the appropriately dimensioned cross-latch 21 is located congruently with the centre piece 18.

The cross-latch 21 is non-rotatably connected to a shaft 22. The shaft 22 can be rotated about a vertical axis, which lies on the longitudinal mid-axis 23 of the stowage piece 10. The shaft 22 passes through the centre piece 18 and the abutment 15. The shaft 22 is guided in a corresponding through hole 24 which extends centrally through the centre piece 18, the abutment 15 and a centre piece 28 arranged underneath. The centre piece 25 is connected in one piece to the abutment 15, like the centre piece 18. The centre piece 25 is again of oval design and has an outline which corresponds approximately to the upper slot 26 in the upper corner fitting 13 of the lower container. The centre piece 25 has a lower height than the centre piece 18. In the exemplary embodiment shown, it is approximately only half as high, as a result of which the centre piece 25 extends only partly into the slot 26 in the corner fitting 13. The result is that a flat underside 27 of the centre piece 25 ends at about half the height of the slot 26. In addition, the stowage cone 17 has a rotatable cone head 28, whose outline corresponds to the oval outline of the centre piece 25. The cone head 28 is non-rotatably connected to that end of the shaft 22 which is located opposite the cross-latch 21.

In the locking position of the stowage piece 10 which is shown in FIGS. 1 to 3, by contrast with the cross-latch 21, the cone head 28 is congruent with the centre piece 25 having an identical outline. The dimensions of the cone head 28 are such that when containers are stacked one above another, an upper part of the cone head 28 is located in that part of the slot 26 in the corner fitting 13 which is not filled by the centre piece 25. As a result, the cone head 28 is non-rotatably guided in the slot 26 in the corner fitting 13, as a result of which the cross-latch 21 cannot come out of the locked position shown in FIGS. 1 to 3, as long as the stowage cone 17 is located in the slot 26.

When the stowage cone 17 is free, by means of rotating the cone head 28 via the shaft 22, the cross-latch 21 can be rotated out of the locked position shown in the figures into an unlocked position, in which the cross-latch 21 is congruent with the centre piece 18, but the cone head 28 extends transversely with respect to the centre piece 25, that is to say is rotated through 90° with respect to the position shown in FIGS. 1 to 3.

In addition, the cone head 28 can be fixed non-rotatably with respect to the centre piece 25 by means of a locking element. The locking element 29 is arranged in the cone head 28 of the stowage cone 17, specifically in an aperture 30 which is freely accessible from opposite sides. The locking element 29 is essentially completely accommodated in the aperture 30.

The locking element 29 has a flat, horizontal plate 31 which, on its underside, has a cylindrical handle 32. Opposite the plate 31, two parallel pins 33 project upwards. The pins 33 extend through corresponding through holes in that part of the cone head 28 which is located above the aperture 30. By means of a compression spring (not shown), the handle 32 with the plate 31 and the pin 33 is pressed upwards against a top wall 34 of the aperture 30. At the same time, upper end regions of the pins 33 project upwards beyond the cone head 28 and extend into corresponding blind holes 35 in the centre piece 25. In this way, the pins 33 bring about the-form-fitting rotational securing of the cone head 28 with respect to the centre piece 25.

If the locking element 29, that is to say the plate 31 with the handle 32 and the pins 33, is pressed downwards counter to the spring force of the compression spring, the projecting free end regions of the pins 33 are moved completely into the cone head 28, that is to say come out of engagement with the blind holes 35 in the centre piece 25. The cone head 28 with the shaft 22 and the cross-latch 21 can then be rotated about the vertical longitudinal mid-axis 23 of the stowage piece 10.

Figure 4:
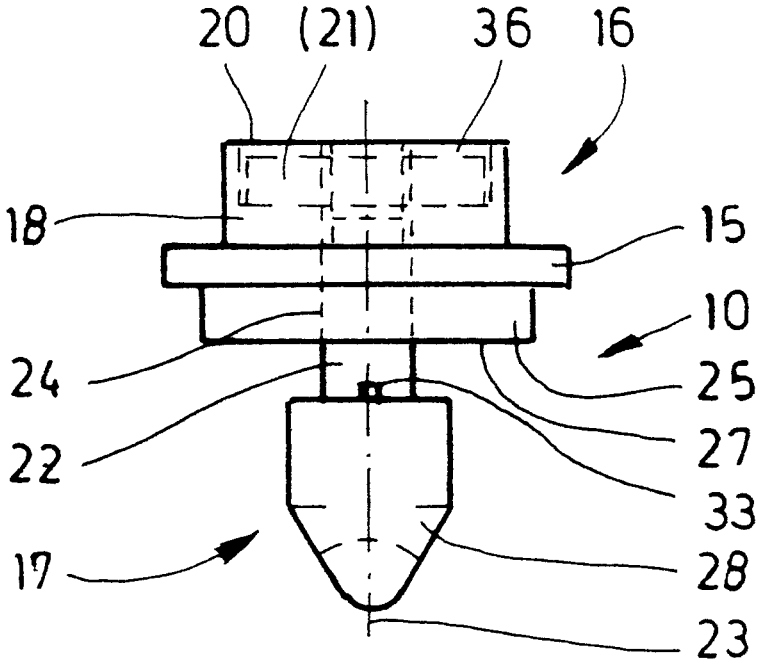
FIG. 4 shows one of the stowage pieces of FIGS. 1 to 3 in an unlocked position.

Arranged in the upper stowage cone 16, starting from its flat upper side 20, is a recess 36, which is dimensioned so as to correspond to the cross-latch 21, which is somewhat smaller than the centre piece 18. The depth of the recess 36 is chosen such that the cross-latch 21 is completely accommodated in it (FIG. 4). The recess 36 is located in the centre piece 18 in such a way that when the cross-latch 21 is located in an unlocked position, when its longitudinal axis coincides with the longitudinal axis of the centre piece, as a result of a downwards movement of the cone head 28 with the shaft 22, the cross-latch 21 can be drawn into the recess 36 in the centre piece 18, as FIG. 4 shows. If the cone head 28 is forced upwards under the underside 27 of the centre piece 25, at the same time the projecting pins 33 of the locking element 29 coming into contact with the underside 27 of the centre piece 25 and, in so doing, being able to be pressed downwards counter to the spring force of the compression spring on the handle 32, the cross-latch 21 comes out of the recess 36 in the centre piece 18. By means of subsequent rotation of the cone head 28, the cross-latch 21 is also rotated by the shaft 22 into the position shown in FIGS. 1 to 3, where the longitudinal axis of the cross-latch 21 extends transversely with respect to the longitudinal axis of the centre piece 18. In this locked position of the cross-latch 21, the stowage piece 10 is at the same time locked under the upper corner fitting 12 of the relevant container. The underside of the cross-latch 21 rests on the upper side 20 of the centre piece 18, so that, in the locking position, the cross-latch 21 cannot pass into the recess 36 and the cone head 28 remains underneath the underside 27 of the centre piece 25, so that the pins 33 remain in engagement in the blind holes 35 in the centre piece 25 and secure the cross-latch 21 in the locked position.

The stowage piece 11 has a plate-like distance piece 37 and a cross-latch 38 that is preferably connected to it in one piece. The stowage piece 11 is connected with the cross-latch 38 alongside an outer, upright side wall of the corner fitting 12. To this end, a centre piece 39 of the cross-latch 38, having an approximately cylindrical cross section, projects through the lateral slot 14 in the upright side wall of the corner fitting 12. At the same time, the flat rear side 40 of the distance piece 37, which is connected to the cross-latch 38, comes approximately to rest on the upright side wall of the corner fitting 12. At its end directed away from the distance piece 37, the cross-latch 38 has two opposite anchoring lugs 41 which project on opposite sides of the centre piece 39. These anchoring lugs 41 and the round cross section of the centre part 39 are illustrated dashed in FIG. 3.

The anchoring lugs 41 and cross-latch 38 have an oval outline which is such that the cross-latch 38 can be pushed through the slot 14 in the corner fitting 12 with the anchoring lugs 41 pointing upwards and downwards. By means of subsequent rotation of the stowage piece 11 through 90°, the anchoring lugs 41 come to rest on opposite sides of the slot 14, by engaging behind the latter from the interior of the corner fitting 12, as shown by FIG. 3. In this position of the anchoring lugs 41, the stowage piece 11 is locked laterally beside the corner fitting 12.

In particular, FIGS. 2 and 3 show that the cross-latch 38 of the stowage piece 11 and the cross-latch 21 of the upper stowage cone 16 are dimensioned such that, in the locked position of both stowage pieces 10 and 11, the cross-latch 38 of the stowage piece 11 is located directly above the cross-latch 21 of the stowage piece 10, as a result of which, when the stowage piece 10 is locked under the corner fitting 12, the stowage piece 11 in the locked position is secured with a form fit in the slot 14 in the side wall of the corner fitting 12. In order to unlock the stowage piece 11, the stowage piece 10 must first be drawn downwards out of the corner fitting 12, in order that, by rotating the stowage piece 11, the cross-latch 38 comes into a position rotated through 90° with respect to the illustration in FIGS. 2 and 3, in which it is congruent with the slot 14 and can be withdrawn laterally from the latter.

The thickness of the distance piece 37 is dimensioned in a particular way. As FIG. 1 reveals, the distance piece 37 is about half as thick as an interspace 42 between side walls, in particular longitudinal side walls, of corner fittings 12 located beside one another and belonging to adjacent containers. By means of arranging one stowage piece 11 in each case in both lateral slots 14 of mutually oriented corner fittings 12, the two distance pieces 37 of two identical stowage pieces 11 are located opposite each other in the interspace 42 and virtually completely fill this interspace 42, since they both have a thickness of about half the interspace 42, as a result of which block stowage of the containers in adjacent stacks, which is effective in the horizontal direction, is brought about, in which containers in adjacent stacks are supported on each other by their distance pieces 37 projecting with respect to the corner fittings 12.

In the exemplary embodiment shown, an outer side 43 of each distance piece 37 is curved, at least in the vertical direction, namely elevated. This means that when the containers are being stowed, the distance pieces 37 of opposite stowage pieces 11 can slide on one another and, as a result, the containers come into the correct position. Alternatively, it is also conceivable to design the entire outer side 43 to be curved like a saucer, so that the distance pieces 37 of adjacent stowage pieces 11 can slide on one another in the transverse directions as well.

Figure 7:
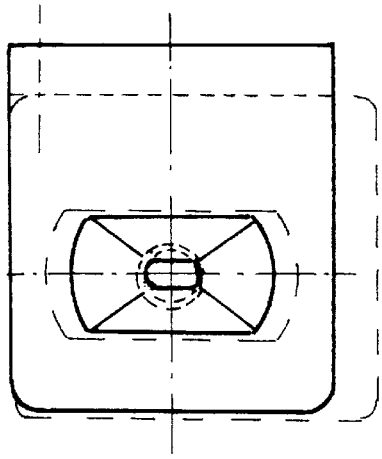
FIG. 7 shows the stowage piece of FIG. 5 in a view from below.
Figure 6:
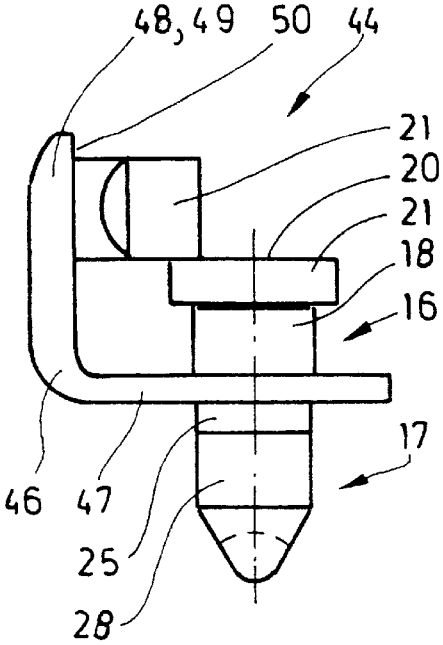
FIG. 6 shows the stowage piece of FIG. 5 in a view rotated through 90°, without the corner fittings indicated, in a locking position.
Figure 5:
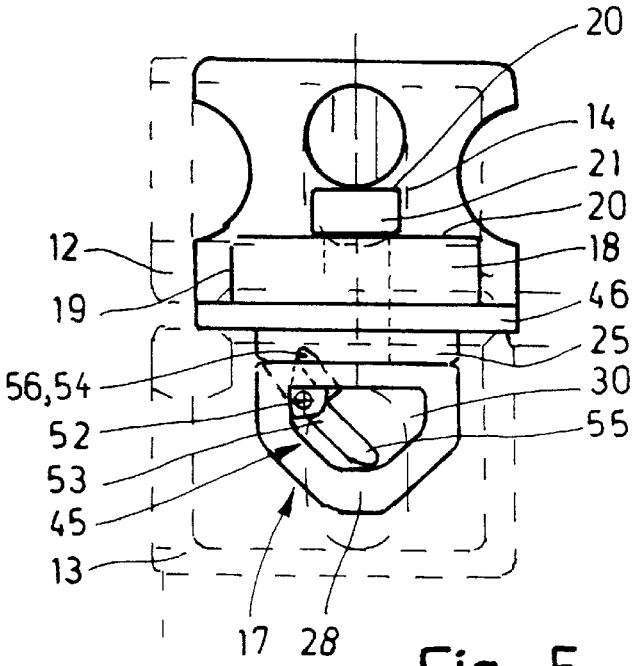
FIG. 5 shows a stowage piece according to a different exemplary embodiment of the invention when arranged between the upper and lower corner fittings of two containers stacked one above another.

FIGS. 5 to 7 show a stowage piece 44 in accordance with a further exemplary embodiment of the invention. This virtually combines the two stowage pieces 10 and 11 to form a single stowage piece 44. The stowage piece 44 corresponds in principle to the stowage piece 10. To this extent, identical reference symbols are used for identical parts. Only the locking element 45 in the aperture 30 in the cone head 28 of the lower stowage cone 17 is designed differently from the locking element 29. Furthermore, the abutment 46 is angled over, specifically at a right angle. As a result, the abutment 46 is approximately L-shaped in a side view (FIG. 6). A longer leg 47 of the abutment 46 is designed for horizontal arrangement between an upper corner fitting 13 and a lower corner fitting 12 of containers stacked one above another. Another, shorter leg 48 is connected in one piece, vertically oriented, to one edge of the long leg 47. This leg 48 of the abutment 46 forms a distance piece 49, which in terms of its function corresponds to the distance piece 37 of the separate stowage piece 11. The distance piece 49 on the abutment 46 thus also rests on a vertical outer side of the corner fitting 12 of the upper container.

Permanently connected to the rear side 50 of the distance piece 49, pointing towards the corner fitting 12, is an anchoring projection 51 which, in the exemplary embodiment shown, is of cylindrical design. This anchoring projection 51 extends so as to be oriented transversely with respect to the rear side 50 of the distance piece 49. The cylindrical anchoring projection 51 projects through the lateral slot 14 in the corner fitting 12 when the stowage piece 44 is locked in the same. The anchoring projection 51 is arranged on the distance piece 49 in such a way that the cross-latch 21 of the upper stowage cone 16 is located with its flat upper side 20 close underneath the anchoring projection 51, when in its locked position (FIG. 5). If, in the unlocked position, the cross-latch 21 rests in the recess 36 in the centre piece 18, the spacing between the then shortened upper stowage cone 16 and the underside of the anchoring projection 51 is sufficiently great for the stowage cone 16 to be withdrawn completely from the lower slot 19 in the corner fitting 12, as a result of which the anchoring projection 51 can correspondingly be moved downwards in the lateral slot 14. After that, in order to detach the stowage piece 44 completely from the corner fitting 12, the anchoring projection 51 can be withdrawn from the lateral slot 14 in the corner fitting 12 by means of a sideways movement of the entire stowage piece 44.

Here, the locking element 45 is designed as a latch 53 which can be pivoted in a vertical plane about a horizontal pivot 52. The pivot 52 is permanently mounted in a lateral upper corner region of the aperture 30 in the cone head 28. The latch 53 is designed as a double lever with two unequally long legs 54 and 55, which are angled over, specifically by an obtuse angle. A shorter leg 54 of the latch 53, which points approximately upwards in the locking position (FIG. 5), projects upwards with respect to the rotatable cone head 28 into a corresponding recess 56 in the centre piece 25. The recess 56 may be a groove which extends in the longitudinal direction of the centre piece 25, so that the leg 54 of the latch 53 comes into engagement with the groove-like recess 56 in opposite (rotated through 180°) positions of the cone head 28 and, as a result, locks the cross-latch 21 in its locked position. A longer leg 55 of the latch 53 projects obliquely downwards in the locked position shown in FIG. 5 and, in so doing, rests with its end at the bottom on the aperture 30. As a result of this design and arrangement of the latch 53, it is ensured that the latch 53 automatically comes into the locking position shown. The locking of the latch 53 is released by raising the lower leg 55 and pivoting the latch in the anticlockwise direction (as referred to the illustration in FIG. 5). At the same time, the originally approximately vertically upstanding shorter leg 54 is rotated back from an approximately vertical position into an approximately horizontal position, the projecting end of the leg 54 coming out of the recess 56, and the cone head 28 being rotatable with respect to the centre piece 25 of the lower stowage cone 17 in order to transfer the cross-latch 21 of the upper stowage cone 16 from the locking position shown in the figures into an unlocking position, in which the cross-latch 21 becomes congruent with the centre piece 18.

Figure 9:
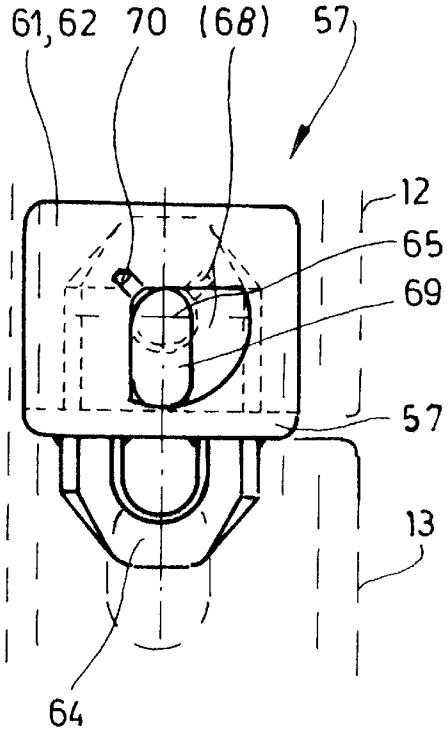
FIG. 9 shows one of the stowage pieces shown in FIG. 8 between two corner fittings located one above another, and in the state in which they are locked under a lower corner fitting, in a view towards a lateral distance piece.
Figure 8:
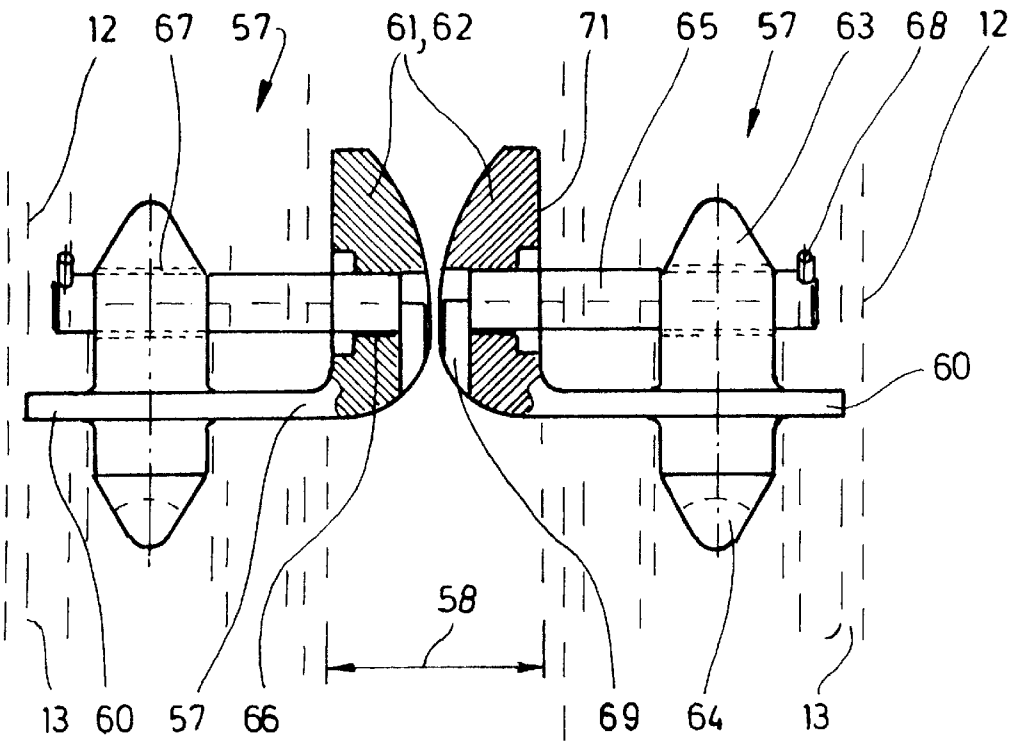
FIG. 8 shows two identical stowage pieces according to a further exemplary embodiment of the invention between corner fittings of containers stacked one above another and beside one another (analogous to FIG. 1)

FIGS. 8 and 9 show a further exemplary embodiment of a stowage piece 57. This stowage piece 57 corresponds in principle to the stowage piece 44, that is to say it is also used simultaneously to secure the containers of a stack against horizontal displacement and to transmit compression between the containers of adjacent stacks (FIG. 8).

The stowage piece 57 also has an approximately L-shaped abutment 59. The abutment 59 has a longer leg 60 located between corner fittings 12 and 13 located one above another, and a shorter leg 61, moulded in one piece on one side of the leg 60, to form a distance piece 62. The distance piece 62 is angled over at a right angle with respect to the long leg 60 and is provided with a greater thickness than the distance piece 49 of the stowage piece 44. Consequently, the distance pieces 62 of two such stowage pieces 57 can bridge the interspace 58 in FIG. 8, which is somewhat broader than the interspace 42 in FIG. 1.

The longer leg 60 of the abutment 59 between corner fittings 12 and 13 located one above another has a longer stowage cone 63 on its upper side and a shorter stowage cone 64 on its underside. The stowage cones 63 and 64 are connected in one piece to the leg 60 of the abutment 59, that is to say both are non-rotatable.

The stowage piece 57 is locked under a lower corner fitting 12 of an upper container by means of a locking bolt 65 which, oriented approximately horizontally, can be pushed through the distance piece 62 and the upper, longer stowage cone 63, specifically through appropriate through holes 66, 67 in the distance piece 62 and in the stowage cone 63. The locking bolt 65 extends horizontally through the distance piece 62 and the stowage cone 63, in that it extends parallel to and at a spacing from the leg 60 of the abutment 59 located between the corner fittings 12 and 13.

The free end of the locking bolt 65 which is pushed through the stowage cone 63 is provided with a laterally projecting securing pin 68. The securing pin 68 can be pushed through a corresponding groove 70, which originates from the through hole 67 in the stowage cone 63, in order to push the locking bolt 65 through the stowage cone 63 or to withdraw it from the latter again. By means of rotating the locking bolt 65 by means of a handle 69 arranged on its opposite end, assigned to the distance piece 62, the securing pin 68 of the locking bolt 65 can be brought out of alignment with the continuous groove 70 providing the lateral widening of the through hole 67, as a result of which the locking bolt 65 cannot slide independently out of the stowage cone 63.

Provided in the distance piece 62, on that side 71 of the distance piece 62 which rests laterally on the corner fitting 12, is a circumferential widening of the through hole 66. This widening is used to accommodate the securing pin 68 on the locking bolt 65 when the stowage piece 57 is to be mounted on the corner fitting 12 or removed from the latter. As a result, the end of the locking bolt 65 with the securing pin 68 can be pushed into the distance piece 62 to such an extent that it does not project with respect to the rear side 71. On the other hand, the securing pin 68 prevents the complete withdrawal of the locking bolt 65 from the distance piece 62, so that the locking bolt 65 cannot be lost.

When the locking bolt 65 is withdrawn completely from the stowage cone 63, when its right-hand end terminates flush with the rear side 71 of the distance piece 62, the stowage piece 57 can be fixed under the lower corner fitting of an upper container 12, in that first of all the stowage cone 63 is pushed through the slot 19 in the lower corner fitting 12 until the horizontal leg 60 of the abutment 59 rests under the corner fitting 12. At the same time, the distance piece 62 comes to rest beside an outer side face of the corner fitting 12. By means of pushing the locking bolt 65 through the stowage cone 63, the locking bolt 65 passes through the lateral slot 14 in the corner fitting 12.

Figure 10:
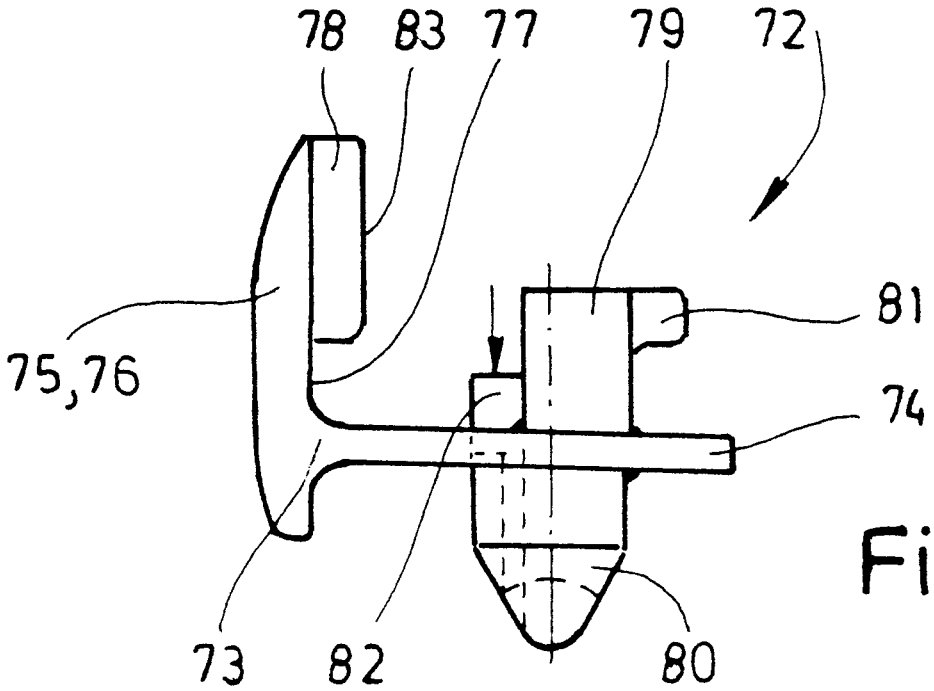
FIG. 10 shows a stowage piece according to a further exemplary embodiment of the invention.
Figure 11:
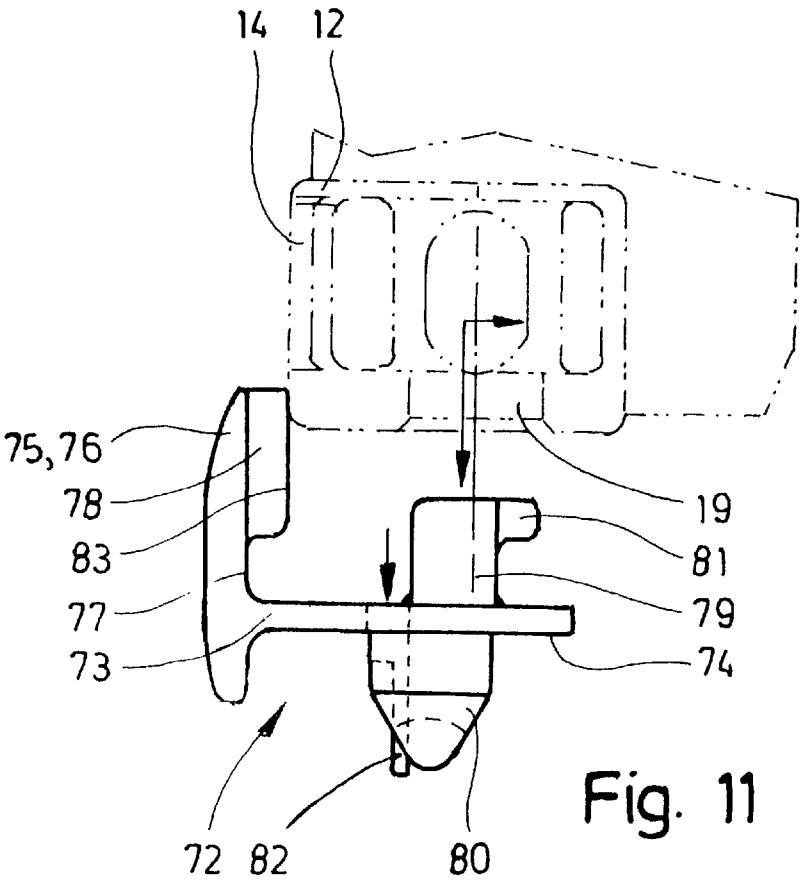
FIG. 11 shows the stowage piece of FIG. 10 before being connected to a lower corner fitting of an upper container.
Figure 12:
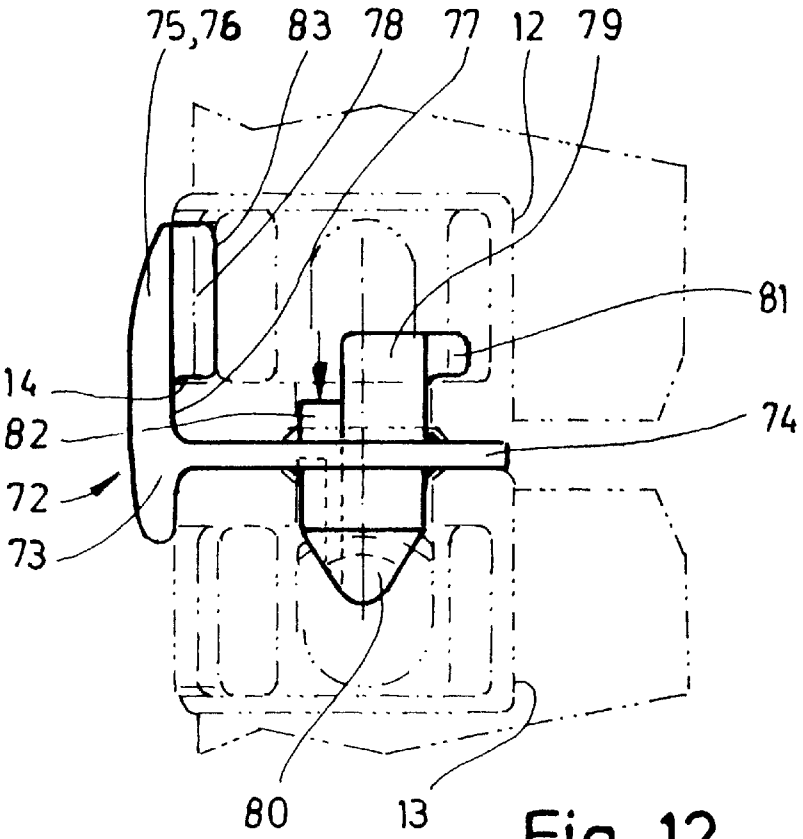
FIG. 12 shows the stowage piece of FIG. 11 locked under the lower corner fitting.

FIGS. 10 to 12 show a stowage piece 72 which essentially corresponds to the stowage piece 57 of FIGS. 8 and 9. Here, however, there is an abutment 73 which is angled over in a T shape and has two legs 74 and 75. A horizontal leg 74 is located between corner fittings 12, 13 located one above another and belonging to two containers, while the respectively angled-over (outer) vertical leg 75 forms a distance piece 76. The distance piece 76 here projects on both opposite sides of the horizontal leg 74 of the abutment 73, specifically both upwards and downwards. As a result, the distance piece 76 rests on upright side faces of the two adjacent corner fittings 12, 13 of containers stacked one above another. By this means, corner fittings 12, 13 on adjacent corners of four containers are mutually supported in the horizontal direction. In the case of the block stowage of containers with the stowage piece 72, in this way particularly high forces can be transmitted, because upper corner fittings 13 located beside one another, and also lower corner fittings 12 are supported in the horizontal direction, by the distance piece 76 or the leg 75, against distance pieces 76 of the stowage pieces 72 of adjacent containers of another container stack. The previously described stowage pieces 11, 44 and 57 can also be provided with distance pieces 76 which permit the lower corner fittings 12 and upper corner fittings 13 of adjacent containers to be supported. It is also conceivable to provide the stowage piece 72 with a distance piece which is used only to support the lower corner fittings 12 or upper corner fittings 13 of adjacent containers.

The rear side 77 of the distance piece 76, which rests on an upright side of the corner fitting 12, is connected in one piece to an oval projection 78. The projecting 78 corresponds to the lateral slot 14 in the corner fitting 12, so that it can engage in the slot 14 from outside and essentially fills the latter (FIG. 12).

The horizontal leg 74 of the abutment 73 has a stowage cone 79 and 80, respectively, at the top and bottom in each case. The upper stowage cone 79 and the lower stowage cone 80 are connected in one piece to the leg 74 of the abutment 73. The upper stowage cone 79 has, at its upper free end, a laterally projecting anchoring lug 81. The anchoring lug 81 projects so as to be oriented horizontally with respect to that side of the stowage cone 79 facing away from the distance piece 76. That side of the stowage cone 79 which is opposite the anchoring lug 81 and points towards the distance piece 76 is provided with a recess, which is assigned a filler 82. The filler 82 is mounted such that it can be moved up and down in the horizontal leg 74 of the abutment 73 and in the lower stowage cone 80, specifically in such a way that it can be pressed up by a spring (not shown) into the position shown in FIGS. 10 and 12. The filler 82 can be pressed downwards, counter to the spring force, to such an extent that it leaves the area of the upper stowage cone 79 completely, that is to say terminates with its upper end approximately flush with the upper side of the leg 74 of the abutment 73 (FIG. 11).

When the filler 82 is pressed down, the upper stowage cone 79, together with the laterally projecting anchoring lug 81, has an outline which is somewhat smaller than that of the lower slot 19 in the lower corner fitting 12. As a result, when the filler 82 is pressed down, the stowage piece 72 can be inserted into the corner fitting 12 from below through the slot 19. In the process, a flat, horizontal end face 83 of the projection 78 slides past outside the corner fitting 12 on its side wall. As soon as the stowage piece 72 has been fitted under the corner fitting 12, that is to say the leg 74 of the abutment 73 is resting under the underside of the corner fitting 12, the entire stowage piece 72 can be displaced with respect to the corner fitting 12 by means of a horizontal displacement in the direction of the centre of the container. In the process, the projection 78 on the rear side 77 of the distance piece 76 comes into engagement with the slot 14 in the corner fitting 12, and the rear side 77 of the distance piece 76 comes to rest on the side face of the corner fitting 12. At the same time, the anchoring lug 81 on the stowage cone 79 engages behind the slot 19 of the corner fitting 12 from the inside. In this way, the stowage piece 72 is secured under the corner fitting 12 both by the projection 78 engaging in the lateral slot 14 and also by the anchoring lug 81 engaging from the inside in the corner fitting 12 in the vertical direction under the corner fitting 12.

As a result of the above-described lateral movement of the stowage piece 72 with respect to the corner fitting 12, an interspace is produced between the slot 19 and the stowage cone 79, and is filled by the filler 82 when the latter is released and pressed up by the spring force into a position beside the stowage cone 79 (FIG. 12). The filler 82 then prevents any horizontal displacement of the stowage piece 72 under the corner fitting 12, and thus the stowage piece 72 cannot be detached from the corner fitting 12 by being pushed back.

List of Reference Symbols

| | |
|---|---|
| 10 | Stowage piece |
| 11 | Stowage piece |
| 12 | Corner fitting |
| 13 | Corner fitting |
| 14 | Slot |
| 15 | Abutment |
| 16 | Stowage cone |
| 17 | Stowage cone |
| 18 | Centre piece |
| 19 | Slot |
| 20 | Upper side |
| 21 | Cross-latch |
| 22 | Shaft |
| 23 | Longitudinal mid-axis |
| 24 | Through hole |
| 25 | Centre piece |
| 26 | Slot |
| 27 | Underside |
| 28 | Cone head |
| 29 | Locking element |
| 30 | Aperture |
| 31 | Plate |
| 32 | Handle |
| 33 | Pin |
| 34 | Top wall |
| 35 | Blind hole |
| 36 | Recess |
| 37 | Distance piece |
| 38 | Cross-latch |
| 39 | Centre piece |
| 40 | Rear side |
| 41 | Anchoring lug |
| 42 | Interspace |
| 43 | Outer side |
| 44 | Stowage piece |
| 45 | Locking element |
| 46 | Abutment |
| 47 | Leg |
| 48 | Leg |
| 49 | Distance piece |
| 50 | Rear side |
| 51 | Anchoring projection |
| 52 | Pivot |
| 53 | Latch |
| 54 | Leg |
| 55 | Leg |
| 56 | Recess |
| 57 | Stowage piece |
| 58 | Interspace |
| 59 | Abutment |
| 60 | Leg |
| 61 | Leg |
| 62 | Distance piece |
| 63 | Stowage cone |
| 64 | Stowage cone |
| 65 | Locking bolt |
| 66 | Through hole |
| 67 | Through hole |
| 68 | Securing pin |
| 69 | Handle |
| 70 | Groove |
| 71 | Rear side |
| 72 | Stowage piece |
| 73 | Abutment |
| 74 | Leg |
| 75 | Leg |
| 76 | Distance piece |
| 77 | Rear side |
| 78 | Projection |
| 79 | Stowage cone |
| 80 | Stowage cone |
| 81 | Anchoring lug |
| 82 | Filler |
| 83 | End face |

What is claimed is:

1. A stowage piece for securing the position of containers on board ships, having an abutment (15, 46, 59, 73) that is arranged at least partly between corner fittings (12, 13) of containers located one above another, and at least two stowage cones (16, 17; 73, 74; 79, 80) arranged on opposite sides of the abutment (15, 46, 59, 73), characterized in that a first of the at least two stowage cones cooperates with a locking means, with which this stowage cone (16, 63, 79) can be locked under the corner fitting (12) of a container, wherein the locking means is designed as a cross-latch (21), which can be brought from a locking position into an unlocking position by rotation of a second of the at least two stowage cones (17), and the rotatable stowage cone (17) cooperates with the locking means for securing the cross-latch (21), at least in the locking position.

2. The stowage piece according to claim 1, characterized in that the locking means is arranged in a recess (30) in the rotatable stowage cone (17), the recess (30) being designed such that the locking means is accessible from outside.

3. The stowage piece according to claim 1, characterized in that the locking means has at least one anchoring projection, which can be brought into engagement with at least one corresponding recess in the abutment (15, 46) or a centre piece (25) corresponding to the abutment (15, 46).

4. The stowage piece according to claim 3, characterized in that arranged underneath the abutment (15) is the centre piece (25) which is permanently connected to the abutment (15), which forms part of the rotatable stowage cone (16) and extends only over part of the depth of a slot (26) in the corner fitting (13) corresponding to the stowage piece, and another part of the depth of the slot (26) in the corner fitting (13), into which the centre piece (25) does not extend, is filled by part of the rotatable stowage cone (17).

5. The stowage piece according to claim 1, characterized in that the first of the at least two stowage cones (16) has a recess (36) which is designed to correspond to an anchoring means in such a way that the anchoring means (21) is accommodated in the recess (36) when in its unlocking position.

6. The stowage piece according to claim 5, characterized in that when the anchoring means (21) is accommodated in the recess (36) in the upper stowage cone (16), an anchoring projection on a distance piece (37; 49; 76) can be inserted into a relevant slot (14) in the corner fitting (12).

7. The stowage piece according to claim 5, characterized in that the anchoring means (21) is connected to a second of the at least two stowage cones (17) via a central, vertical pivot (22), and the pivot (22), with the second stowage cone (17), can be displaced vertically in order to move the locking means (21) into the recess (36) and out of the recess (36).

8. A stowage piece for securing the position of containers on board ships, the containers having side wall, side faces and end walls, the stowage piece having an abutment (46, 59, 73) and having at least two stowage cones (63, 64; 79, 80) arranged on opposite sides of the abutment (46, 59, 73), characterized in that the abutment (46, 59, 73) corresponds with a spacer between the side walls of adjacent containers or the side faces assigned to the end walls and belonging to corner fittings (12) of adjacent containers, wherein a first of the at least two stowage cones and has a recess (36) which is designed to correspond to an anchoring means in such a way that the anchoring means (21) is accommodated in the recess (36) when in its unlocking position, and the anchoring means (21) is connected to a second of the at least two stowage cones, which is a rotatable stowage cone (17), via a central, vertical pivot (22), and the pivot (22), with the rotatable stowage cone (17), can be displaced vertically in order to move the locking means (21) into the recess (36) and out of the recess (36).

9. The stowage piece according to claim 8, characterized in that a respective spacer is designed as a plate-like distance piece (37; 49; 62; 76), which extends vertically, the distance piece (37; 49; 62; 76) resting on at least one vertical side face of the corner fitting (12), to which a first of the at least two stowage cones (16; 63; 70) corresponds.

10. The stowage piece according to claim 8, characterized in that a distance piece (76) rests on vertical side faces of adjacent corner fittings (12, 13) of containers located one above another.

11. The stowage piece according to claim 8, characterized in that a distance piece (37; 49; 62; 76) has a thickness which corresponds approximately to half the interspace (42; 58) between mutually facing upright side walls of adjacent containers, with approximately half the spacing between two containers located beside each other or mutually facing side faces of the corner fittings (12) of containers located beside each other.

12. The stowage piece according to claim 8, characterized in that a distance piece (62) and the stowage cone (63) cooperates with the same corner fitting (12) and can be connected by a locking means, the locking means being designed such that it can be pushed through a lateral slot (14) in a relevant corner fitting (12).

13. The stowage piece according to claim 8, characterized in a distance piece (27; 49; 76) comprises an anchoring projection which can be brought into engagement with a slot (14) in an upright side face of the corner fitting (12).

14. A stowage piece for securing the position of containers on board ships, characterized by a distance piece (37, 49, 62, 76) which is to be arranged laterally beside a side fence of at least one corner fitting (12) of at least one container, and whose thickness is approximately half the interspace (42, 58) between adjacent containers or adjacent corner fittings (12) of containers located beside each other.

15. The stowage piece according to claim 14, characterized in that the distance piece is designed to rest on side faces of adjacent corner fittings (12, 13) of containers located one above another.

16. The stowage piece according to claim 14, characterized in that the distance piece (37) is assigned a cross-latch (38) for anchoring the stowage piece (11) to the corner fitting (12) corresponding to the distance piece and belonging to the container.

17. The stowage piece according to claim 14, characterized in that the distance piece (37) and a cross-latch (38) are connected to each other in one piece and non-rotatably, wherein the cross-latch (38) is pushable through a slot (14) in a side face of the corner fitting (12) to which the distance piece (37) corresponds.

18. The stowage piece according to claim 14, characterized in that a cross-latch (38) can be locked to the corner fitting (12) by rotating the cross-latch.

19. The stowage piece according to claim 14, characterized in that the cross-latch (38) is designed in such a way that only its locking position can another stowage piece or coupling piece be inserted into the corner fitting (12) from above or below.

20. A stowage piece for securing the position of containers relative to each other on board ships, comprising a plate-like abutment (15, 46, 59, 73) and at least two stowage cones (16, 17; 73, 74; 79, 80) arranged at opposite sides of the abutment (15, 46, 59, 73), the containers being in a stacked relationship to each other and comprising corner fittings, characterized in that a first of the at least two stowage cones (16, 63, 79) cooperates with a locking means with which the first stowage cone (16, 63, 79) can be locked under a lower corner fitting (12) of an upper container and that the first stowage cone (16, 63, 79) with the locking means can be rotated between a locking position and an unlocking position by rotating a second of the at least two stowage cones (17), wherein the abutment acts to at least partially arrange the containers relative to each other.

21. The stowage piece according to claim 20, characterized in that he locking means is designed as a cross-latch (21) and that the second stowage cone (17) cooperates with the locking means for securing the cross-latch (21) at least in the locking position.

22. A stowage piece for securing the position of containers on board ships, the containers having side wall, side faces and end walls, the stowage piece having an abutment (46, 59, 73) and having at least two stowage cones (63, 64; 79, 80) arranged on opposite sides of the abutment (46, 59, 73), characterized in that the abutment (46, 59, 73) corresponds with a spacer between the side walls of adjacent containers or the side faces assigned to the end walls and belonging to corner fittings (12) of adjacent containers, wherein a first of the at least two stowage cones and has a recess (36) which is designed to correspond to an anchoring means in such a way that the anchoring means (21) is accommodated in the recess (36) when in its unlocking position, and when the anchoring means (21) is accommodated in the recess (36) in the first stowage cone (16), an anchoring projection on a distance piece (37; 49; 76) can be inserted into a relevant slot (14) in the corner fitting (12).

* * * * *